US006628052B2

(12) United States Patent
Piehl

(10) Patent No.: US 6,628,052 B2
(45) Date of Patent: Sep. 30, 2003

(54) ENHANCED ELECTRON FIELD EMITTER SPINDT TIP AND METHOD FOR FABRICATING ENHANCED SPINDT TIPS

(75) Inventor: Arthur Piehl, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 55 days.

(21) Appl. No.: 09/972,430

(22) Filed: Oct. 5, 2001

(65) Prior Publication Data

US 2003/0067258 A1 Apr. 10, 2003

(51) Int. Cl.[7] ..... H01J 1/02

(52) U.S. Cl. ..... 313/309; 313/497; 313/306

(58) Field of Search ..... 313/497, 309, 313/306, 495

(56) References Cited

U.S. PATENT DOCUMENTS 5,814,925 A * 9/1998 Tomihari ..... 313/309

* cited by examiner

*Primary Examiner*—Ashok Patel
*Assistant Examiner*—Glenn Zimmerman

(57) ABSTRACT

An enhanced Spindt-tip field emitter tip and a method for producing the enhanced Spindt-tip field emitter. A thin-film resistive heating element is positioned below the field emitter tip to allow for resistive heating of the tip in order to sharpen the tip and to remove adsorbed contaminants from the surface of the tip. Metal layers of the enhanced field emission device are separated by relatively thick dielectric bilayers, with the metal layers having increased thickness in the proximity of a cylindrical well in which the field emitter tip is deposited. Dielectric material is pulled back from the cylindrical aperture into which the field emitter tip is deposited in order to decrease buildup of conductive contaminants and the possibility of short circuits between metallic layers.

13 Claims, 16 Drawing Sheets

ENHANCED ELECTRON FIELD EMITTER SPINDT TIP AND METHOD FOR FABRICATING ENHANCED SPINDT TIPS

TECHNICAL FIELD

The present invention is related to micro electron field emitter devices and, in particular, to enhanced Spindt tip emitters that may include a sharpening feature, an increased depth of dielectric layers between metal layers without concomitant increase in tip to aperture distances, and pull-back of dielectric surfaces from the emitter tip.

BACKGROUND OF THE INVENTION

The present invention relates to design and manufacture of field emitter tips. A brief discussion of field emission and the principles of design and operation of field emitter tips is therefore first provided in the following paragraphs, with reference to FIG. 1.

When a wire, filament, or rod of a metallic or semiconductor material is heated, electrons of the material may gain sufficient thermal energy to escape from the material into a vacuum surrounding the material. The electrons acquire sufficient thermal energy to overcome a potential energy barrier that physically constrains the electrons to quantum states localized within the material. The potential energy barrier that constrains electrons to a material can be significantly reduced by applying an electric field to the material. When the applied electric field is relatively strong, electrons may escape from the material by quantum mechanical tunneling through a lowered potential energy barrier. The greater the magnitude of the electrical field applied to the wire, filament, or rod, the greater the current density of emitted electrons perpendicular to the wire, filament, or rod. The magnitude of the electrical field is inversely related to the radius of curvature of the wire, filament, or rod.

FIG. 1 illustrates principles of design and operation of a field emitter tip. The field emitter tip 102 rises to a very sharp point 104 from a silicon-substrate cathode 106, or electron source. A localized electric field is applied in the vicinity of the tip by a first anode 108, or electron sink, having a disk-shaped aperture 110 above and around the point 104 of the field emitter tip 102. A second cathode layer 112 is located above the first anode 108, also with a disk-shaped aperture 114 aligned directly above the disk-shaped aperture 110 of the first anode layer 108. This second cathode layer 112 acts as a lens, applying a repulsive electronic field to focus the emitted electrons into a narrow beam. The emitted electrons are accelerated towards a target anode 118, impacting in a small region 120 of the target anode defined by the direction and width of the emitted electron beam 116. Although FIG. 1 illustrates a single field emitter tip, field emitter tips are commonly micro-manufactured by microchip fabrication techniques as regular arrays, or grids, of field emitter tips.

Spindt tips are electron field emitter microdevices, such as the field emitter tip shown in FIG. 1, in which the conical emitter tip is deposited by sputter deposition of a suitable metal or metal alloy onto a substrate. The deposition is carried out following layering and patterning of the dielectric and metallic layers that form the extraction cathode layer and lensing anode layer (108 and 112 in FIG. 1).

Spindt tips are well known in the art, and techniques for fabricating Spindt tips have been developed by designers and manufacturers of field emission devices. However, current Spindt tip designs and fabrication techniques suffer from numerous recognized deficiencies. Current techniques lead to application of Spindt emitter tips relatively closely surrounded by a cylindrical well through the dielectric and metal layers perpendicular to the substrate on which the emitter tip is deposited. Undesirable electrostatic charges may build up on the dielectric surfaces of the well during Spindt tip operation. It is well known that the very fine points of field emitter tips may be contaminated with absorbed contaminants and/or deformed during usage, greatly effecting the current density of emitted electrons. Once fabricated, Spindt tips are notoriously difficult, or impossible, to sharpen and clean in order to restore optimal performance. Current fabrication techniques limit the width of dielectric layers separating metallic layers to approximately the height of the final Spindt tip, so that the point of the Spindt tip is positioned within or near the aperture of the electron extraction cathode, but because of the relatively strong electric fields employed to operate field emission devices, the maximum allowed width of the dielectric may be insufficient to completely prevent dielectric breakdown and shorts between positively and negatively charged metallic layers within the Spindt tip emission device. For these reasons, designers and manufacturers of Spindt tip field emitter tips have recognized the need for a design and manufacturing technique that avoids these recognized deficiencies.

SUMMARY OF THE INVENTION

One embodiment of the present invention is an enhanced electron field emitter Spindt tip with a built-in cleaning and sharpening feature, increased thickness of dielectric layers that increases the breakdown voltage threshold of the device, a greater distance between the field emitter tip and surrounding dielectric surfaces, and a method that allows for increased fabrication precision and that allows for economical and efficient addition of additional metallic layers that allow the direction of the electron beam emitted from the field emitter tip to be controlled. Additional fabrication precision is made possible by using two-layer dielectric bilayers within the device: a $SiO_2$ sublayer and a $Si_3N_4$ surface layer that serves as a lateral oxide etch stop during etching of internal chambers. In the enhanced Spindt-tip device, the $Si_3N_4$ surface layer also coats the dielectric portions of the walls of the cylindrical well in which the Spindt tip is deposited, and is pulled back from close proximity to the Spindt tip between the metallic layers. Pulling back the $Si_3N_4$ surface layer prevents build-up of electrostatic charge during operation of the Spindt tip and allows for increasing thickness of the dielectric bilayer without, at the same time, increasing the distance between the point of the Spindt tip and the electron extraction anode aperture. A thin-film resistive heating layer is added to the surface of the substrate, between the base of the Spindt tip and the substrate surface. By passing current through the thin-film resistive heating element layer, the Spindt tip can be heated to high temperatures in order to both sharpen the tip and to remove contaminants adsorbed to the tip. Tip sharpening reduces the radius of the tip and correspondingly increases the current density of emitted electrons during operation. The method that represents one embodiment of the present invention for fabricating enhanced Spindt tips employs metal chemical-mechanical-planarization ("CMP") in place of oxide CMP used in currently available methods to allow planarization of the metal layers and more precise control of the positioning of the point of the Spindt tip relative to the field extraction anode.

DETAILED DESCRIPTION OF THE INVENTION

Several embodiments of the present invention are described below with reference to FIGS. 2–16. In FIGS. 2–9 both a cross-sectional view and a perspective view are shown of a region of a layered substrate that includes a nascent Spindt tip during the fabrication process. In FIGS. 10–16, only cross-sectional views are shown. These figures are not meant to imply particular dimensions or shapes of Spindt tip devices fabricated according to the method of the present invention. Instead, these figures are meant to illustrate the fabrication steps. The size and dimensions of particular Spindt-tip devices are controlled in the design of photolithographic patterning masks by controlling various parameters, including time, solution composition, ion fluxes, and other such parameters, during fabrication steps. Although the figures illustrate fabrication of a single Spindt-tip, the techniques are generally employed to simultaneously fabricate large numbers of Spindt-tips in arrays of field emitter tips.

Figure 2A:
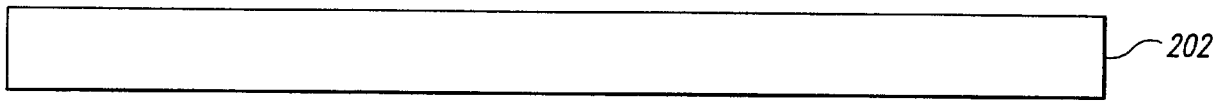
FIG. 2A shows an initial substrate upon which one or more Spindt tips are fabricated in a cross-sectional view.
Figure 2B:
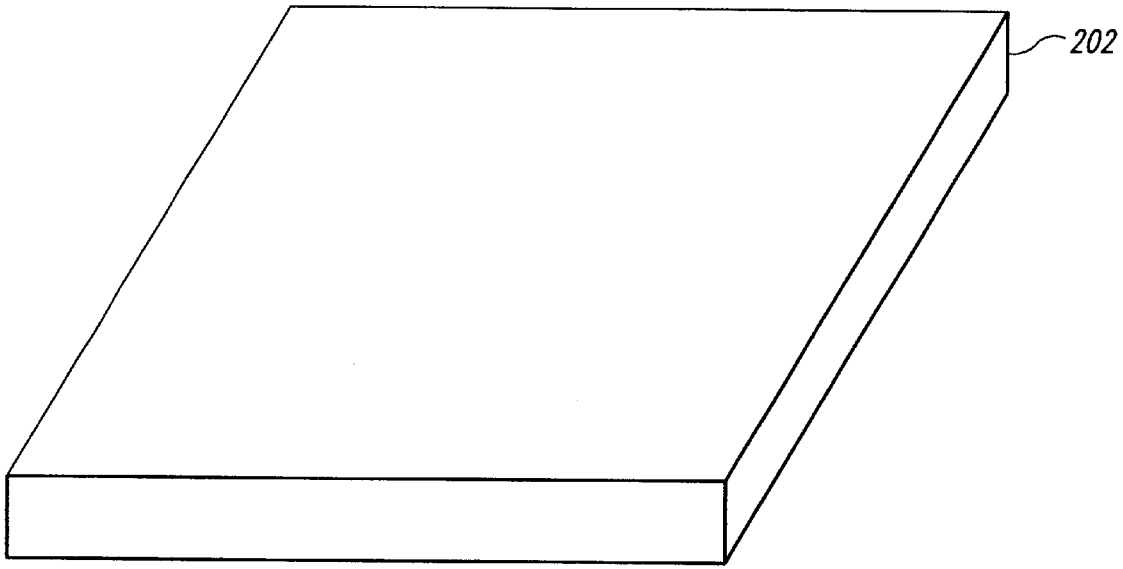
FIG. 2B shows the initial substrate in a perspective view.

FIG. 2A shows an initial substrate upon which one or more Spindt tips are fabricated in a cross-sectional view, and FIG. 2B shows the initial substrate in a perspective view. The initial substrate 202 may be an $SiO_2$ layer of a silicon wafer that may already include fabricated microelectronic devices and circuits.

Figure 3A:
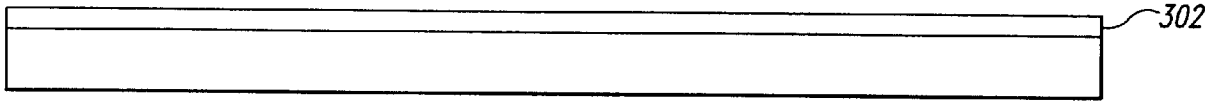
FIG. 3A shows a cross-sectional view of the first step in enhanced field emitter tip fabrication.
Figure 3B:
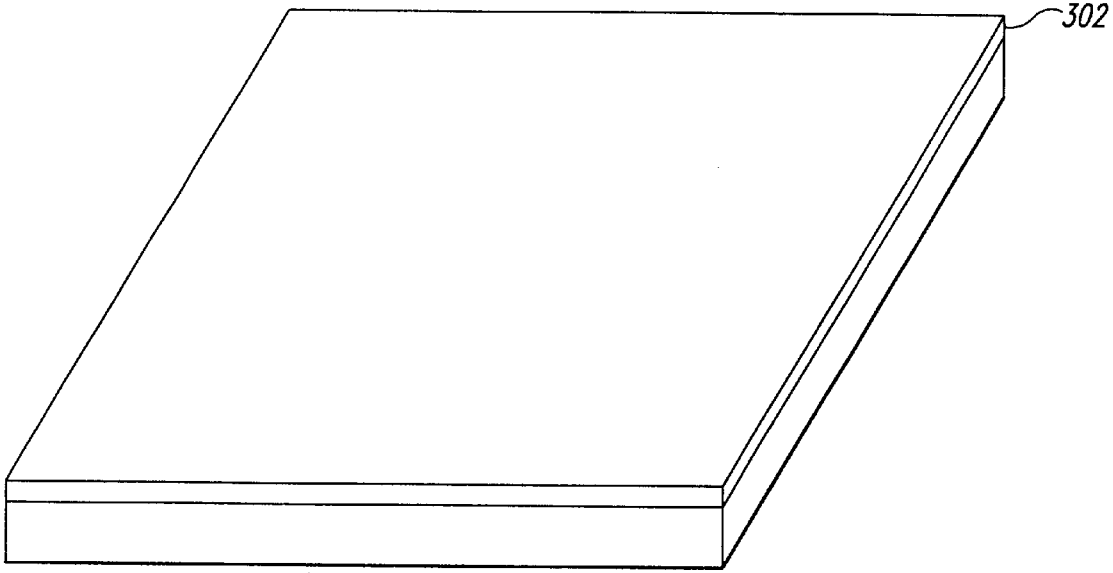
FIG. 3B illustrates the first step in a perspective view.

FIG. 3A shows a cross-sectional view of the first step in enhanced field emitter tip fabrication, and FIG. 3B illustrates the first step in a perspective view. In the first step illustrated in FIGS. 3A–B, a first low-resistivity metallic layer 302 is deposited onto the initial substrate by any of a number of well-known metal deposition methodologies, including vacuum evaporation, physical vapor deposition ("PVD"), chemical vapor deposition ("CVD"), or low pressure chemical vapor deposition ("LPCVD"). In one embodiment, a Ti/TiN layer is deposited by an LPCVD technique to a thickness of approximately 0.15 $\mu$.

Figure 4A:
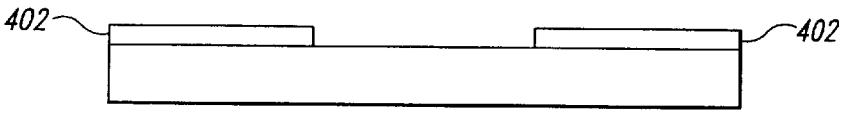
FIGS. 4A–B show a first-metal interconnect on the surface of the substrate following the photolithographic etch step.
Figure 4B:
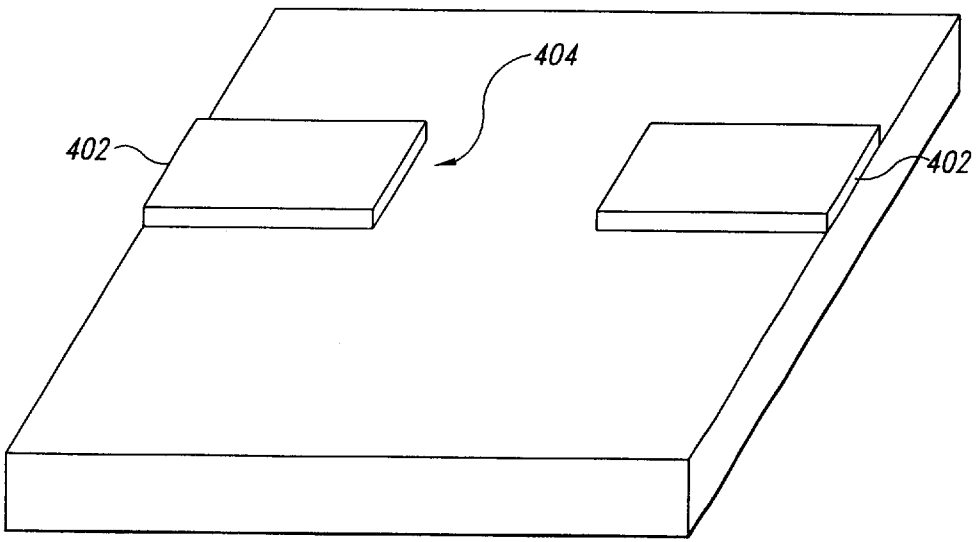

Next, a photoresist layer is applied to the first metal layer and patterned via well-known photolithography techniques. The first metal layer is then etched to produce eventual interconnects to each field emitter tip, and, when a tip heating feature is included as part of the field emitter tip design, a gap in the first-metal interconnect where the tip will be formed. FIGS. 4A–B show a first-metal interconnect on the surface of the substrate following the photolithographic etch step. The interconnect 402 remains after removal of most of the first metal layer (302 in FIG. 3). An interconnect gap 404 is shown, illustrating the fabrication technique used when a heating feature is included.

Figure 5A:
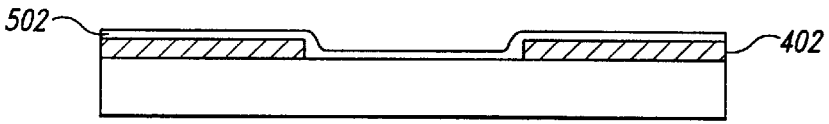
FIGS. 5A–B show the nascent field emitter tip following application of the thin-film resistive heating layer.
Figure 5B:
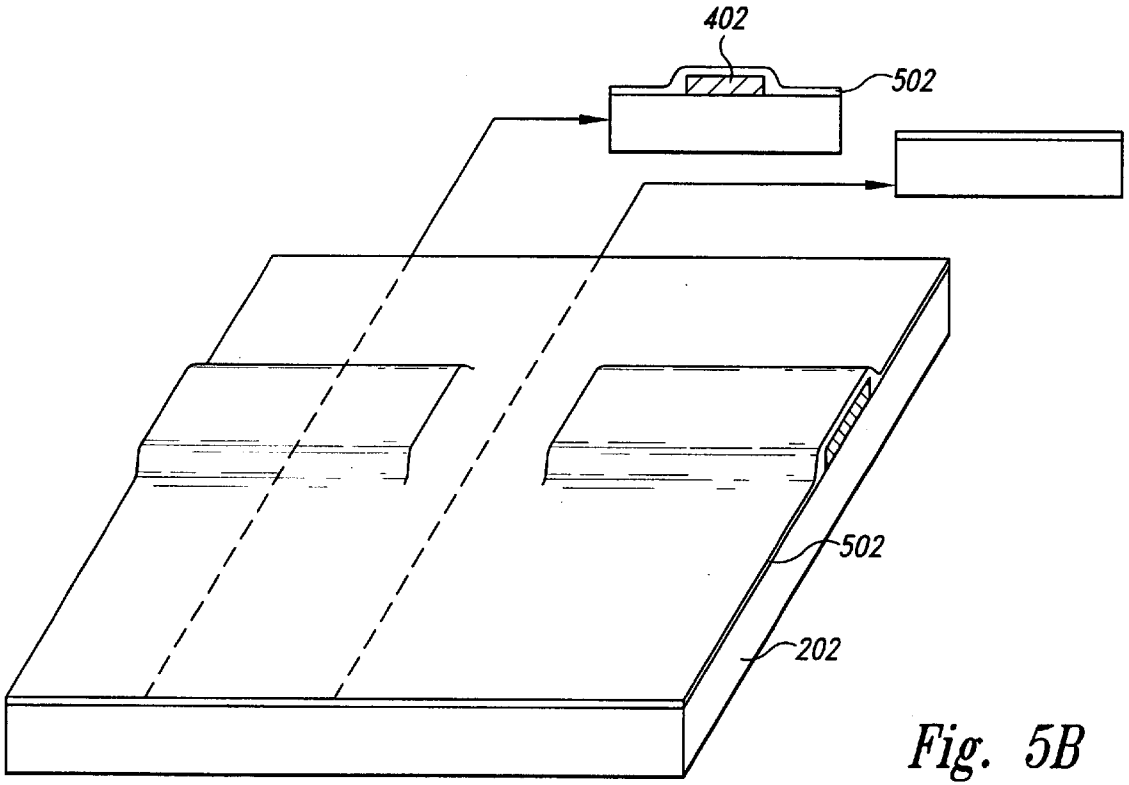

Next, in the case that a heating feature is included in the field emitter tip design, a thin-film resistive heating layer is applied to the surface of the interconnect and substrate. FIGS. 5A–B show the nascent field emitter tip following application of the thin-film resistive heating layer. The thin-film resistive heating layer 502 covers both the interconnect 402 and the exposed substrate 202 surface. After fabrication of the field emitter tip, current can be applied to the thin-film resistive heating layer in order to heat metallic field emitter tips fabricated on the surface of the resistive heating layer. The degree of heating necessary for tip sharpening and removal of contaminants varies with the material used for, and the size and shape of, the field emitter tip. In the case of a molybdenum field emitter tip, a temperature of approximately 400° C. may be necessary, while for a tungsten field emitter tip, a temperature of approximately 1400° C. may be necessary. Resistive heating of the field emitter tip can be applied during manufacture as well as periodically during use of the field emission device containing the resistive heating element. A sophisticated field emission device may include diagnostic logic to detect deterioration of electron current densities emitted by field emitter tips within the device, and to automatically apply resistive heating to tips operating at decreased performance levels.

Figure 6A:
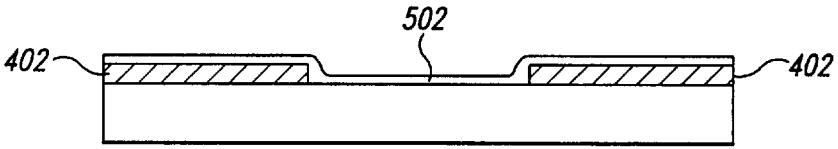
FIGS. 6A–B show the nascent field emitter tip following etching of the thin-film resistive heating layer.
Figure 6B:
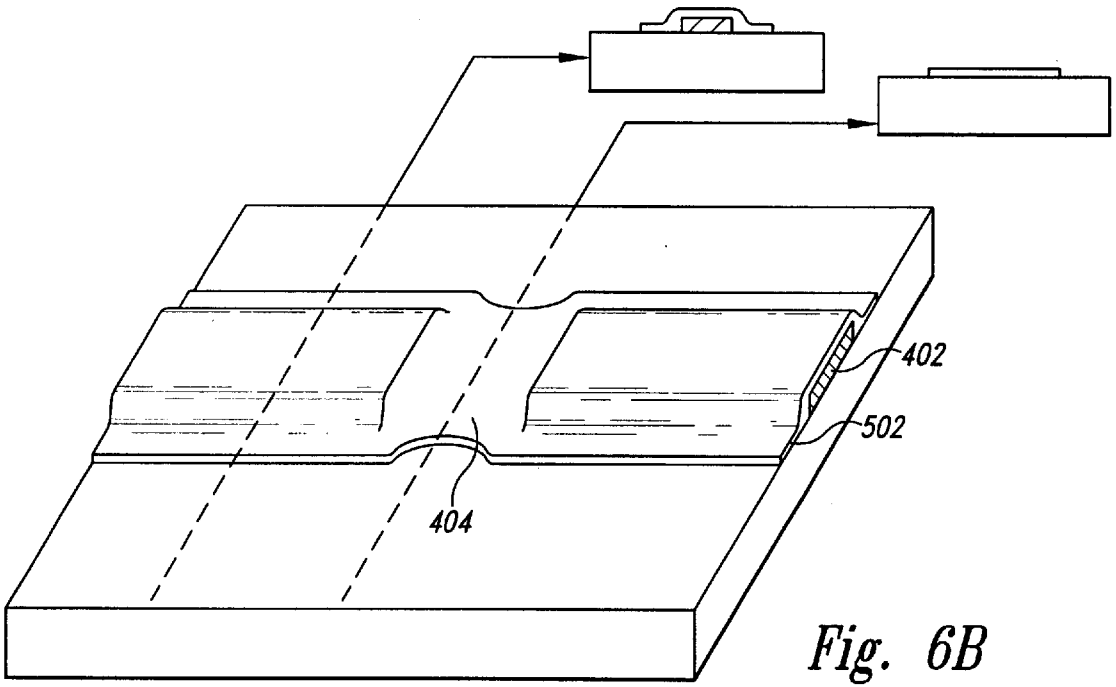

In a next step, in the case that a heating feature is included in the field emitter tip design, the thin-film resistive heating layer is etched, via a photolithographic process, to expose the surface of the substrate not covered by the interconnect and outside the interconnect gap. FIGS. 6A–B show the nascent field emitter tip following etching of the thin-film resistive heating layer. Following the photolithographic process, the thin-film resistive heating layer 502 remains above the interconnect 402 and interconnect gap 404.

Figure 7A:
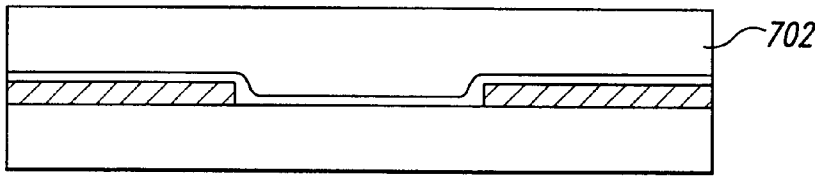
FIGS. 7A–B illustrate the $SiO_2$ dielectric layer deposited over the thin-film resistive heating layer and substrate in cross-section and perspective, respectively.
Figure 7B:
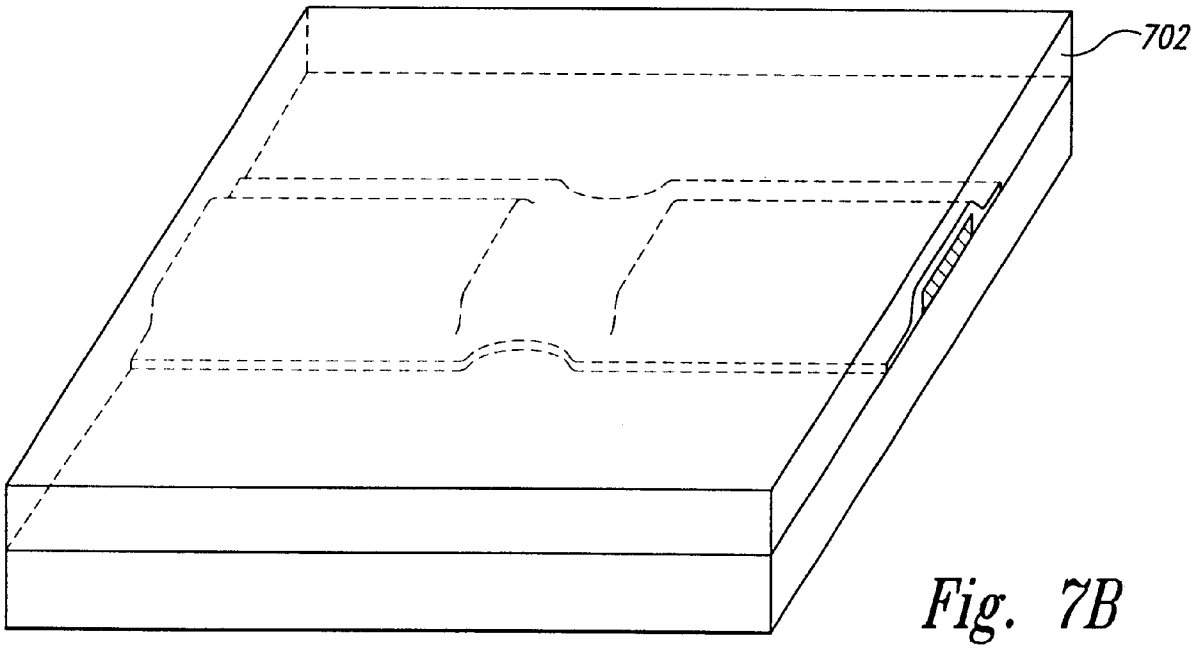

Next, a $SiO_2$ dielectric layer is deposited on the nascent field emitter tip using tetraethyl orthosilicate ("TEOS"), $Si(OC_2H_5)_4$, in a plasma-enhanced chemical vapor deposition ("PECVD") technique. FIGS. 7A–B illustrate the $SiO_2$ dielectric layer deposited over the thin-film resistive heating layer and substrate in cross-section and perspective, respectively. The deposited $SiO_2$ dielectric layer 702, in one embodiment, is approximately 0.4 $\mu$ in depth.

Figure 8A:
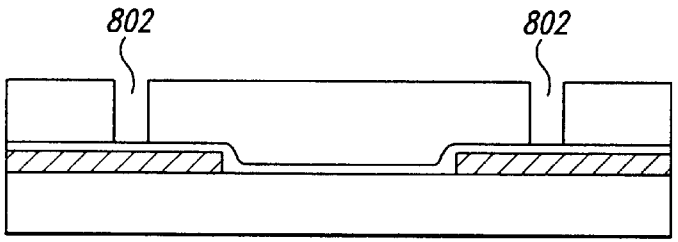
FIGS. 8A–B show the cylindrical slot produced by the etching step.
Figure 8B:
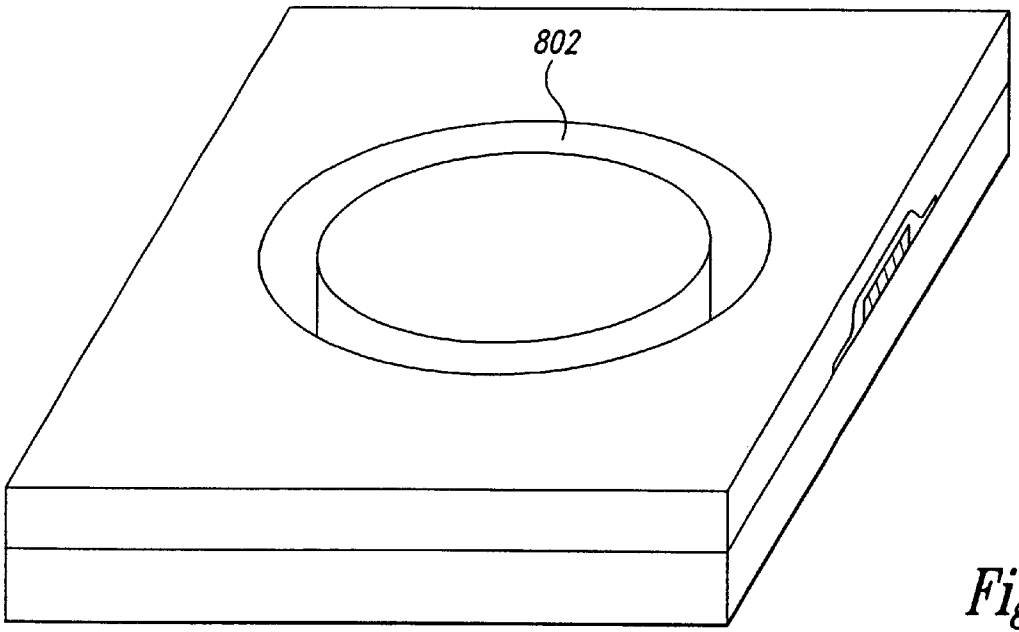

In the next step, a photoresist layer is applied to the $SiO_2$ dielectric layer and is patterned by photolithographic techniques to produce a ring-shaped area of exposed $SiO_2$. This exposed ring is then etched via an anisotropic plasma etching method, or any of various other well-known anisotropic $SiO_2$ etch techniques to produce a cylindrical slot in the $SiO_2$ layer. FIGS. 8A–B show the cylindrical slot produced by the etching step. In one embodiment, the radial width of the cylindrical slot 802 produced by this anisotropic etch step is on the order of 0.3 $\mu$, and the cylindrical slot has a radius of approximately 1.5 $\mu$, so that the perpendicular axis of the Spindt field emitter tip to be fabricated on top of the initial substrate is 1.5 $\mu$ from the walls of the cylindrical slot.

Figure 9A:
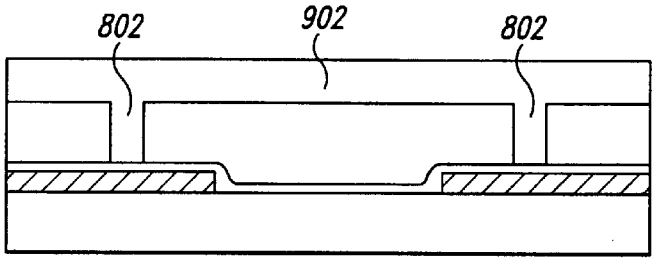
FIGS. 9A–B illustrate the nascent field emitter device following deposition of the $Si_3N_4$ layer above the $SiO_2$ layer in cross-section and perspective, respectively.
Figure 9B:
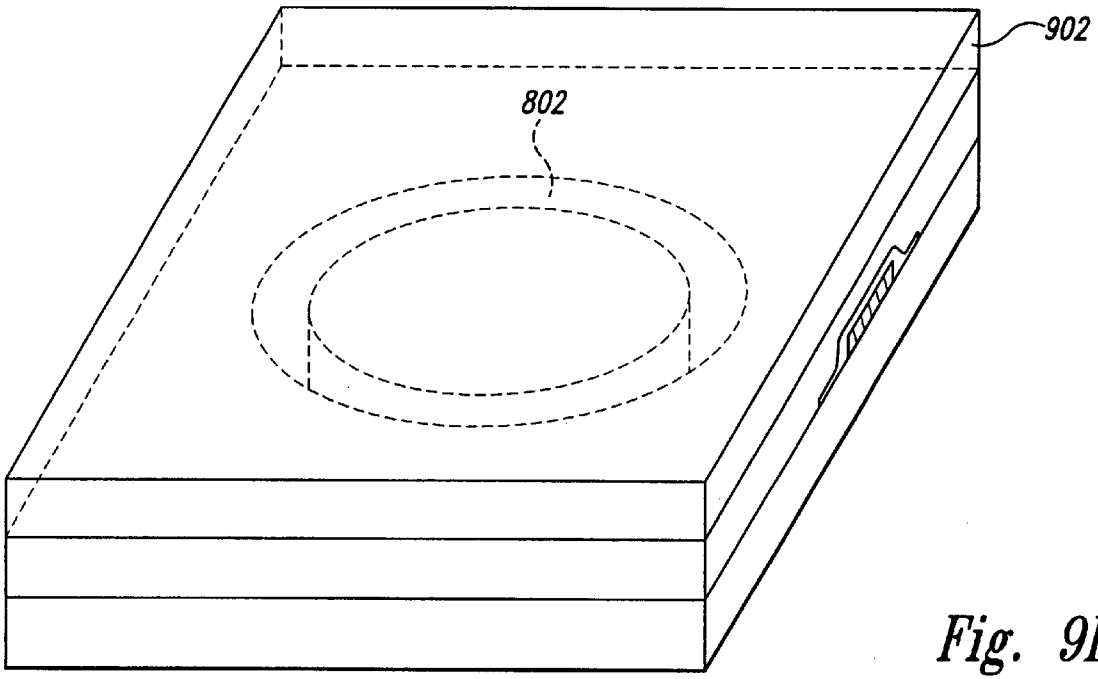

Next, a layer of $Si_3N_4$ is deposited onto the $SiO_2$ dielectric layer in order to produce a first dielectric bilayer. FIGS. 9A–B illustrate the nascent field emitter device following deposition of the $Si_3N_4$ layer above the $SiO_2$ layer in cross-section and perspective, respectively. The $Si_3N_4$ layer 902 is, in one embodiment, deposited by an LPCVD technique in order to efficiently and completely fill the cylindrical slot produced in the previous anisotropic etching of the $SiO_2$ layer and because LPCVD technology produces an $Si_3N_4$ layer with high breakdown voltage characteristics. In one embodiment, the $Si_3N_4$ layer is deposited to a thickness of 0.15 $\mu$ above the underlying $SiO_2$ layer, with the cylindrical slot 802 etched into the $SiO_2$ layer 702 completely filled with $Si_3N_4$ as shown in FIGS. 9A–B.

Figure 10A:
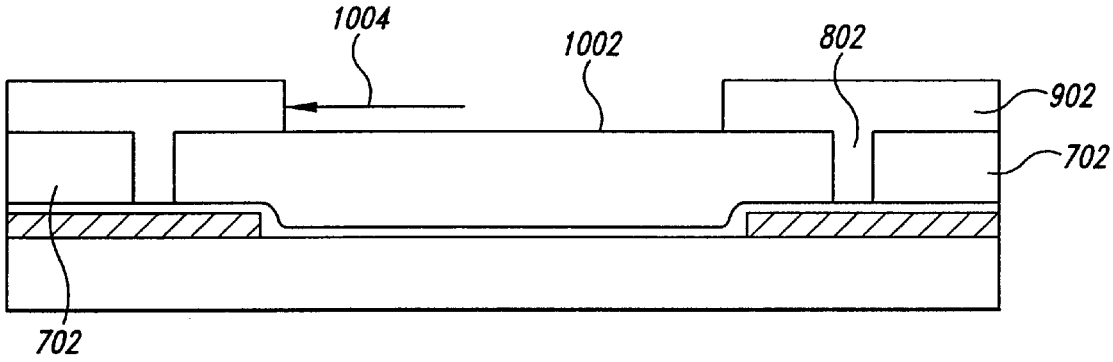
FIG. 10A illustrates the nascent field emission device following deposition and etching of the $Si_3N_4$ layer in cross-section.

Next, a photoresist layer is applied to the surface of the $Si_3N_4$ layer and is patterned by well-known photolithographic techniques to enable etching of a cylindrical aperture centered above the perpendicular axis of the field emitter tip to be subsequently deposited. FIG. 10A illustrates the nascent field emission device following deposition and etching of the $Si_3N_4$ layer in cross-section. In one embodiment, the cylindrical aperture 1002 etched into the $Si_3N_4$ layer 902 has a radius of 1 $\mu$ 1004, significantly less than that of the cylindrical slot 802 etched into the underlying $SiO_2$ layer, now filled with $Si_3N_4$.

Figure 10B:
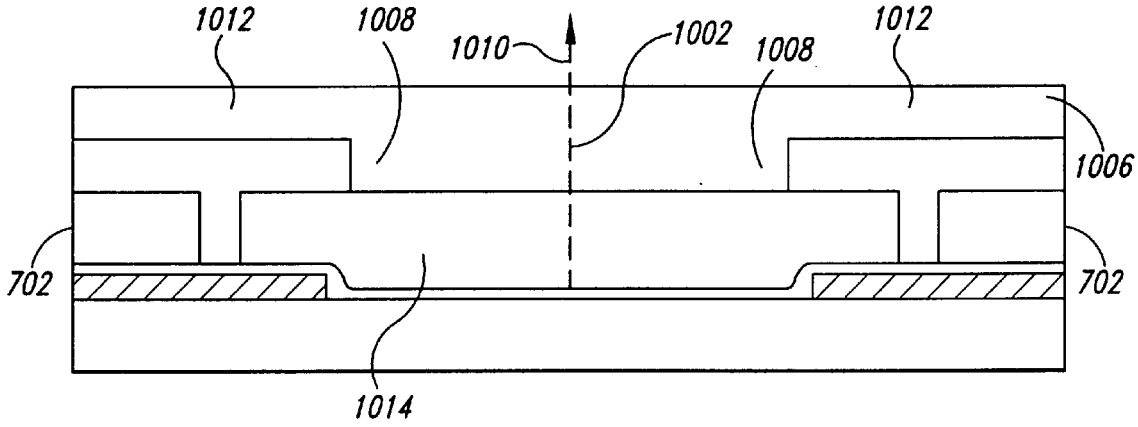
FIG. 10B illustrates the nascent field emission device following deposition of the second metal layer.

Next, a second metal layer is deposited on top of the $Si_3N_4$ layer, filling the cylindrical aperture etched into the $Si_3N_4$ layer in the previous step. FIG. 10B illustrates the nascent field emission device following deposition of the second metal layer. In one embodiment, the second metal layer 1006 is composed of Ti or TiN, deposited to a thickness of 0.4 $\mu$ and is planarized via TiN chemical mechanical polishing ("CMP") to a thickness of 0.3 $\mu$ above the $SiO_2$ layer and 0.15 $\mu$ above the $Si_3N_4$ layer. The second metallic layer 1006 is considerably thicker in the region 1008 close to the axis 1010 of the field emitter tip than in the region 1012 above the first dielectric bilayer comprising the $Si_3N_4$ layer 902 and the $SiO_2$ layer 702. The $Si_3N_4$ layer 902, upon completion of the field emission device, will form vertical walls of a well following removal of a disk-like section of $SiO_2$ 1014. This vertical $Si_3N_4$ surface is resistant to hydrofluoric acid etching of $SiO_2$ to open the internal chambers into which the field emitter tip is deposited, thus allowing for greater dimensional control over the sizes of the chambers etched between metallic layers.

Figure 11A:
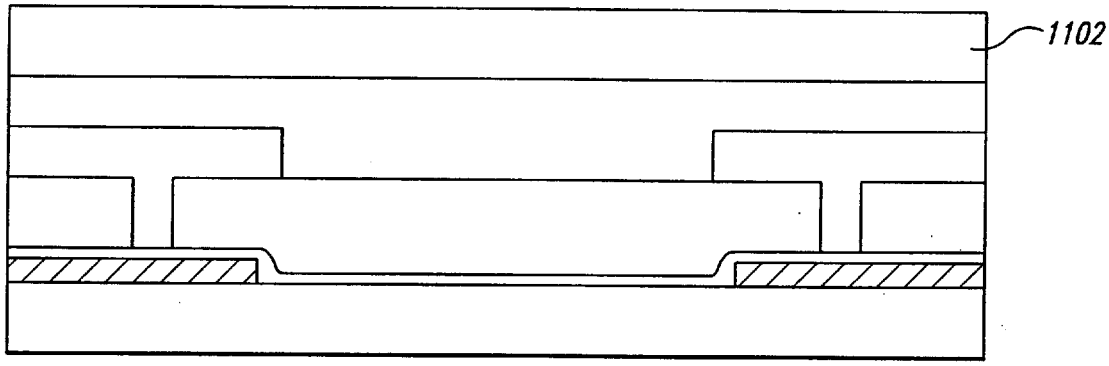
FIG. 11A illustrates deposition of the second $SiO_2$ layer.
Figure 11B:
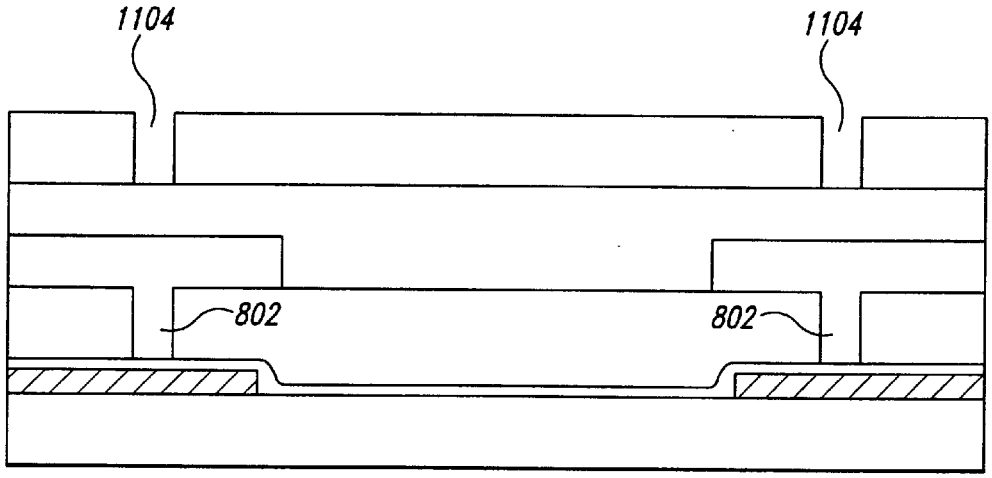
FIG. 11B illustrates the nascent field emission device following patterning and etching of the second $SiO_2$ layer.

Next, a second $SiO_2$ layer is deposited upon the second metallic layer via TEOS deposition, and this second $SiO_2$ layer is patterned and etched to create a second ring-like cylindrical slot identical, or similar to, the ring-like cylindrical slot 802 in the first $SiO_2$ layer 702. The techniques to deposit and pattern the second $SiO_2$ layer 1102 are similar to those used to deposit and pattern the first $SiO_2$ layer, and will not be repeated in the interest of brevity. FIG. 11A illustrates deposition of the second $SiO_2$ layer. FIG. 11B illustrates the nascent field emission device following patterning and etching of the second $SiO_2$ layer. In FIG. 11B, the second ring-like cylindrical slot 1104 is aligned with the first ring-like cylindrical hole 802 in the first $SiO_2$ layer.

Figure 12A:
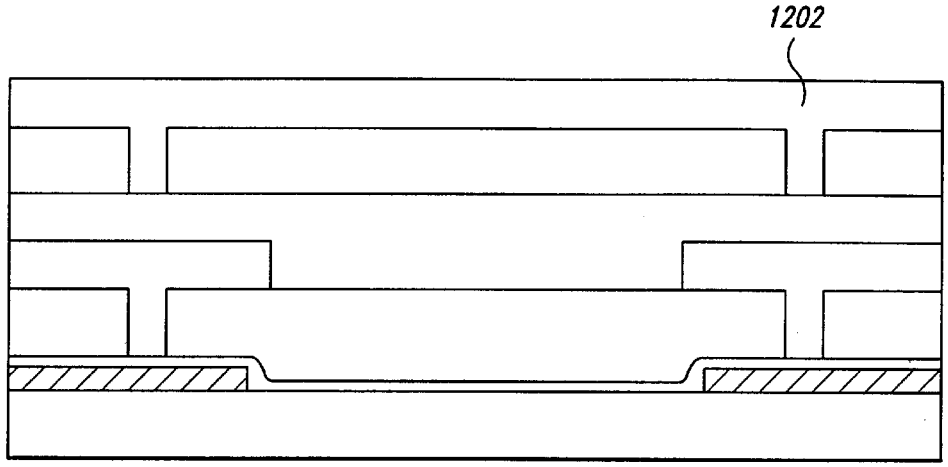
FIG. 12A shows the nascent field emission device following deposition of the second $Si_3N_4$ layer.
Figure 12B:
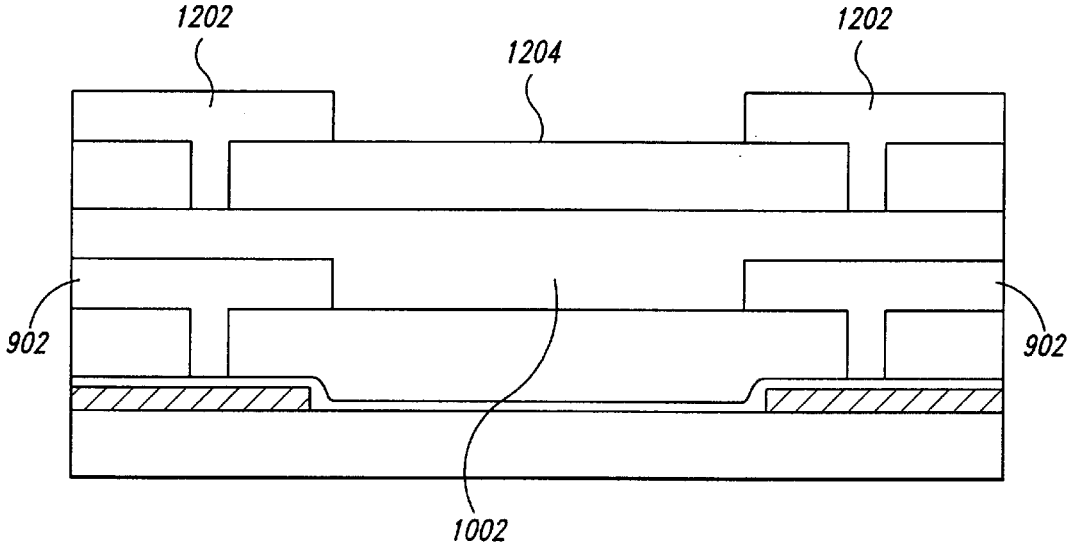
FIG. 12B shows the nascent field emission device following patterning and etching of the second $Si_3N_4$ layer.

Next, a second $Si_3N_4$ layer that comprises the top layer of a second dielectric bilayer is deposited on top of the second $SiO_2$ layer, and then is patterned and etched in the same fashion that the first $Si_3N_4$ layer is deposited, patterned, and etched. FIG. 12A shows the nascent field emission device following deposition of the second $Si_3N_4$ layer. FIG. 12B shows the nascent field emission device following patterning and etching of the second $Si_3N_4$ layer. The second $Si_3N_4$ layer 1202 is etched to produce a second cylindrical aperture 1204 aligned with the cylindrical aperture 1002 of the first $Si_3N_4$ layer 902.

Figure 1:
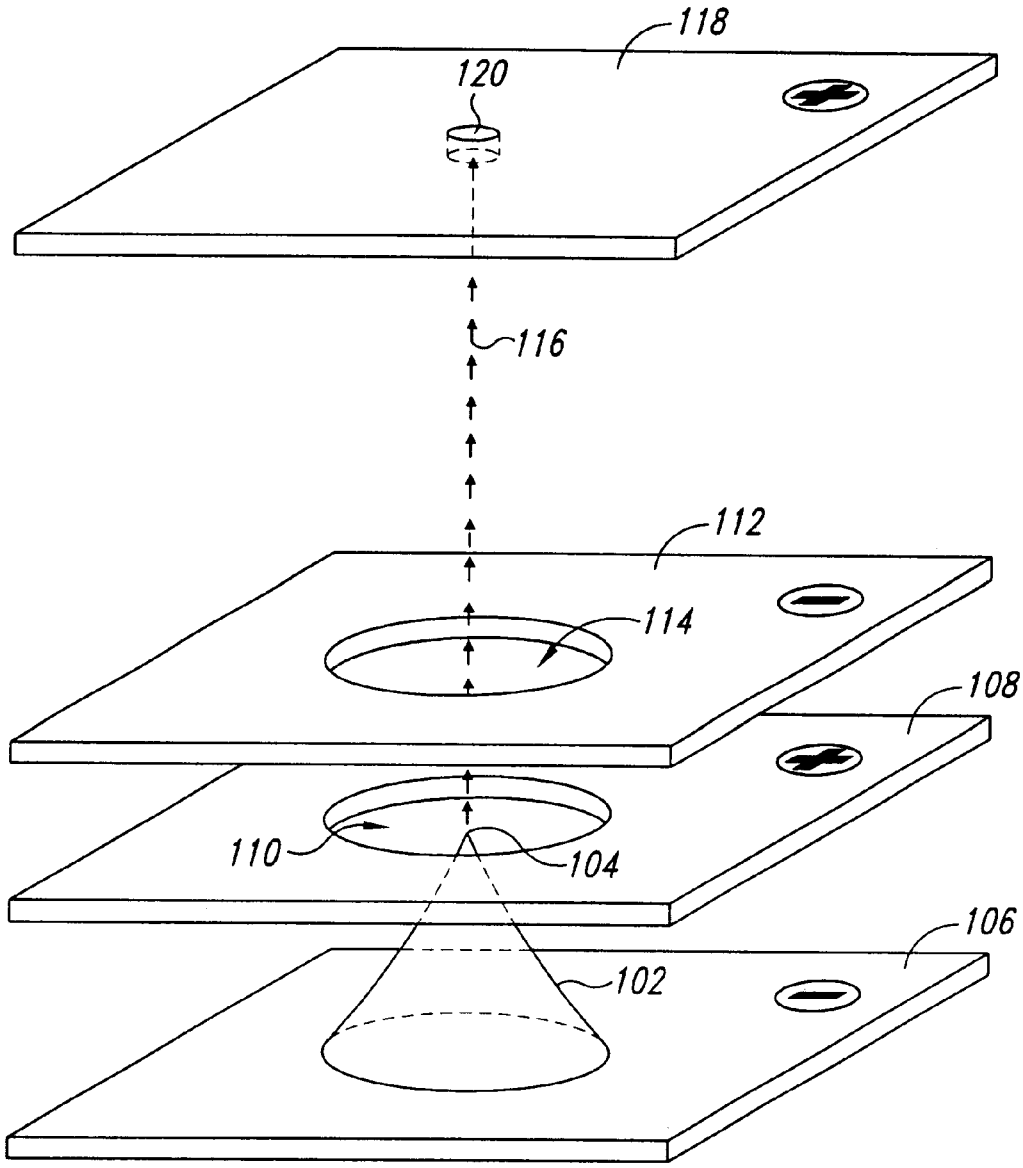
FIG. 1 illustrates principles of design and operation of a silicon-based field emitter tip.
Figure 13A:
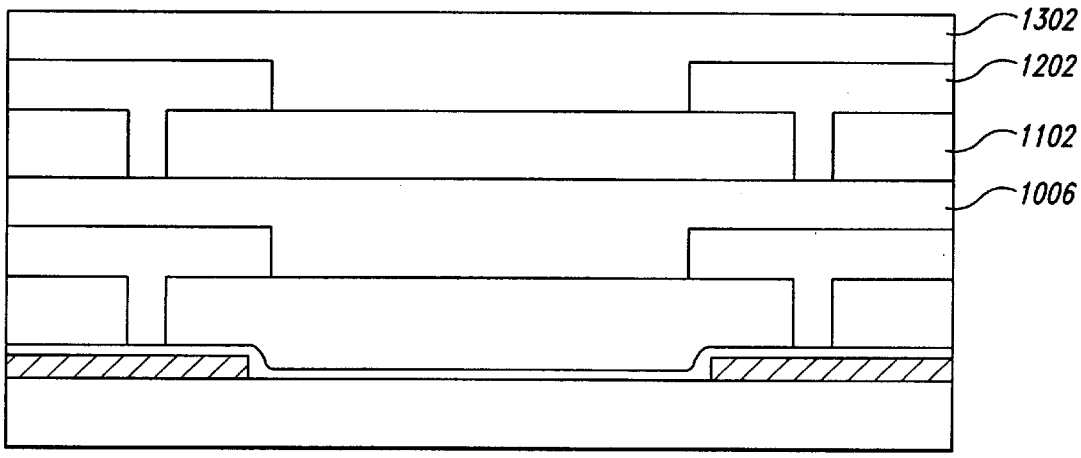
FIG. 13A shows the nascent field emission device following deposition of the third metallic layer.
Figure 13B:
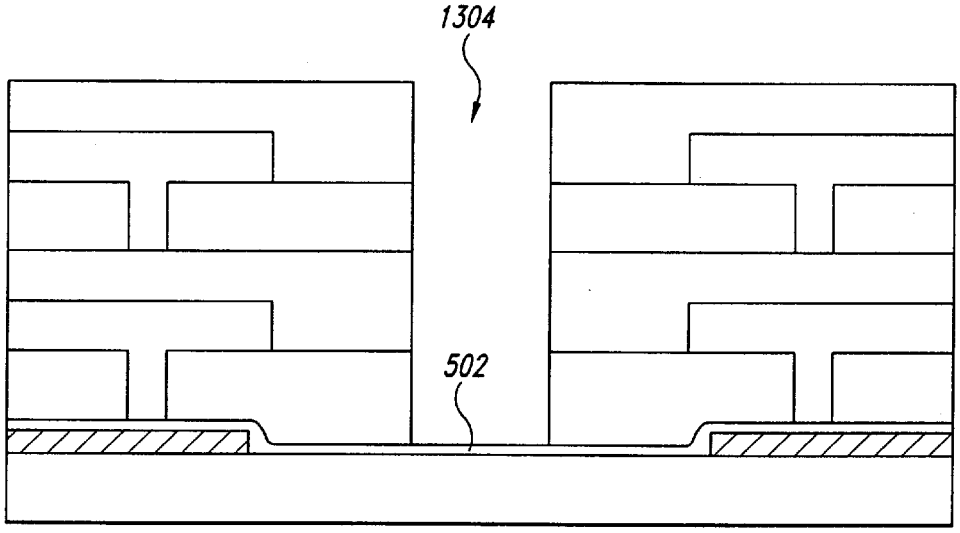
FIG. 13B shows the nascent field emission device following patterning and etching of the third metallic layer, the second oxide layer, the second metallic layer, and the first oxide layer to produce a final central, cylindrical well.

Next, a third metallic layer is deposited on top of the second $Si_3N_4$ layer and a portion of the underlying second $SiO_2$ layer, and is then patterned and etched to produce an aperture that will serve as the aperture of the lens cathode in the completed field emission device, shown as aperture 114 in FIG. 1. FIG. 13A shows the nascent field emission device following deposition of the third metallic layer. The third metallic layer 1302, like the second metallic layer 1006, is thicker in the region close to the axis (1010 in FIG. 10B) of the field emitter tip than in the region above the second dielectric bilayer comprising the $Si_3N_4$ layer 1202 and the $SiO_2$ layer 1102. The third metallic layer is then patterned with photoresist, and an anisotropic etch is performed which etches sequentially the third metallic layer, the second oxide layer, the second metallic layer, and the first oxide layer. By etching the metallic layers in one etch step, one photomasking step is eliminated, and the metal patterns become self-aligned, thereby improving the relative alignment between the layers compared to what could be achieved with separate photomasking and etching steps. FIG. 13B shows the nascent field emission device following patterning and etching of the third metallic layer, the second oxide layer, the second metallic layer, and the first oxide layer to produce a final central, cylindrical well. The central, cylindrical well 1304 extends through to the thin-film resistive heating layer 502.

Figure 14A:
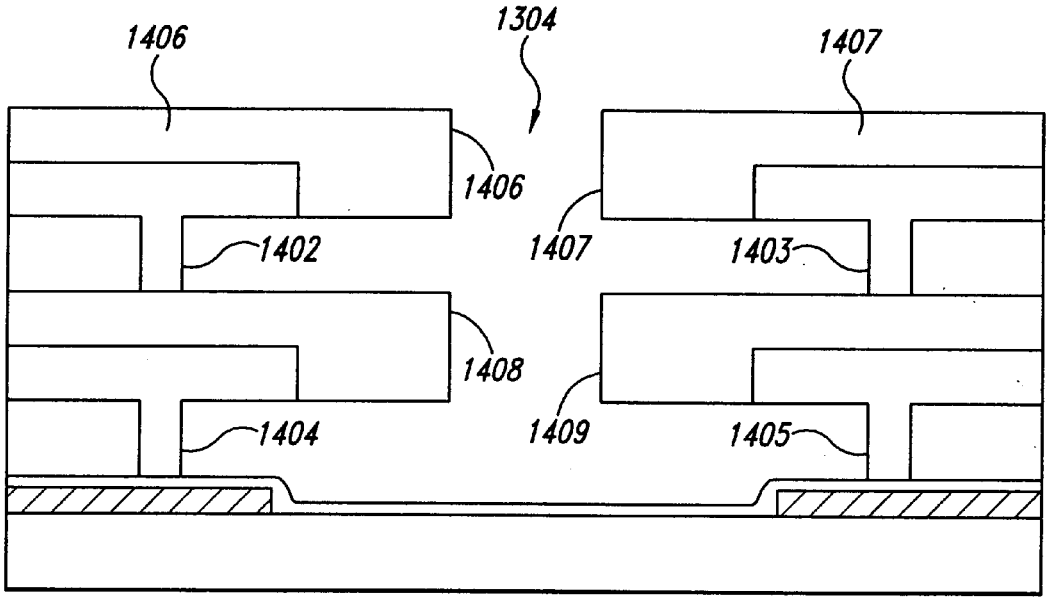
FIG. 14A shows the nascent field emitter tip following this lateral etch.
Figure 14B:
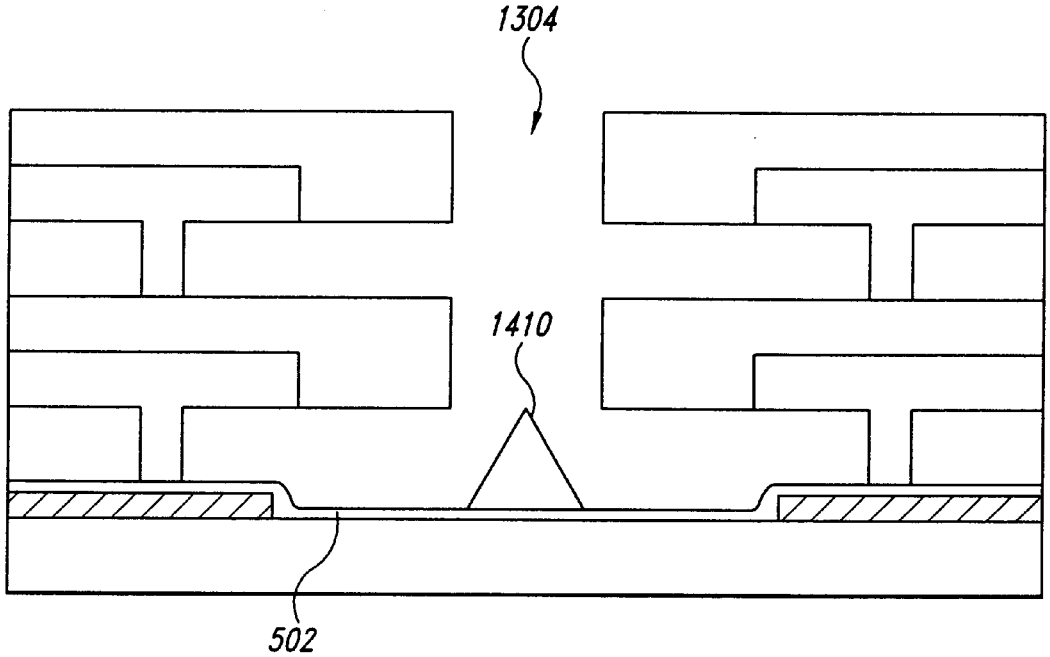
FIG. 14B shows the final Spindt-tip field emitter tip.

In two final steps, a buffered oxide etch ("BOE") employing a buffered hydrofluoric acid solution is used to laterally etch the $SiO_2$ layers back from the walls of the cylindrical well 1304, created in the previous step, to the vertical $Si_3N_4$ rings formed in the ring-like slots etched into the $SiO_2$ layers. FIG. 14A shows the nascent field emitter tip following this lateral etch. The lateral etch step removes the dielectric material from proximity to the field emitter tip, decreasing the chance of electrical shorts due to contamination of dielectric surfaces during operation of the field emission device and eliminating charge buildup on dielectric surfaces in the vicinity of the electron column. Note that, following the lateral etch, the walls of the central, cylindrical well 1304 comprise alternating rings of $Si_3N_4$ 1402–1405 and metal 1406–1409. Then, in the final step for a three-metal-layer field device, a Spindt field emitter tip is deposited through the central aperture via sputter deposition to form the completed field emitter tip. FIG. 14B shows the final Spindt-tip field emitter tip. In one embodiment, the Spindt tip 1410 is composed of a molybdenum and nickel alloy, although molybdenum and tungsten can be used in two alternate embodiments. The conical shape of the field tip is produced by carefully controlling sputter deposition conditions. The Spindt tip 1410 is centrally positioned within the central, cylindrical well 1304 on top of the thin-film resistive heating layer 502.

Figure 15:
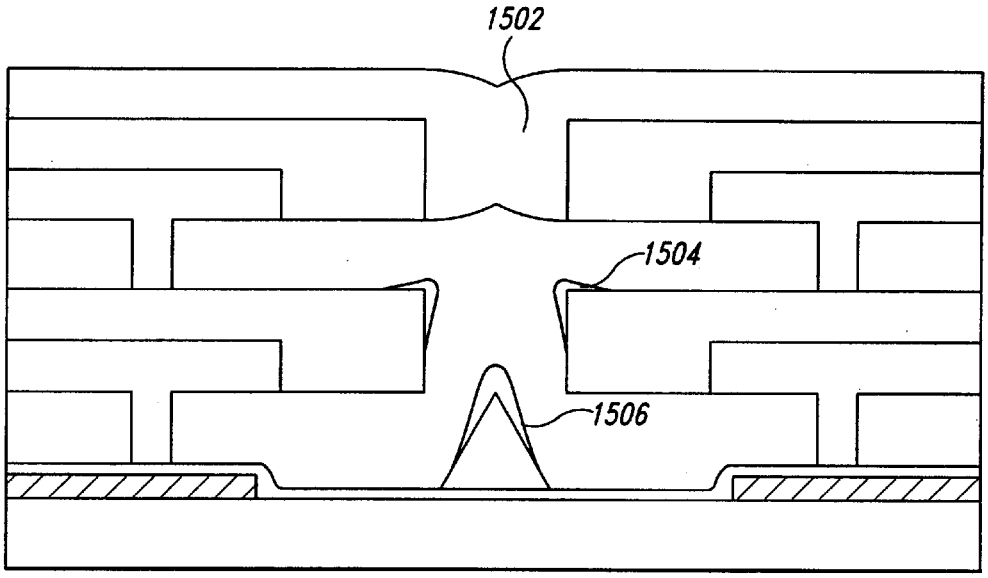
FIG. 15 illustrates application of a next $SiO_2$ layer above the third metallic layer via TEOS deposition.
Figure 16:
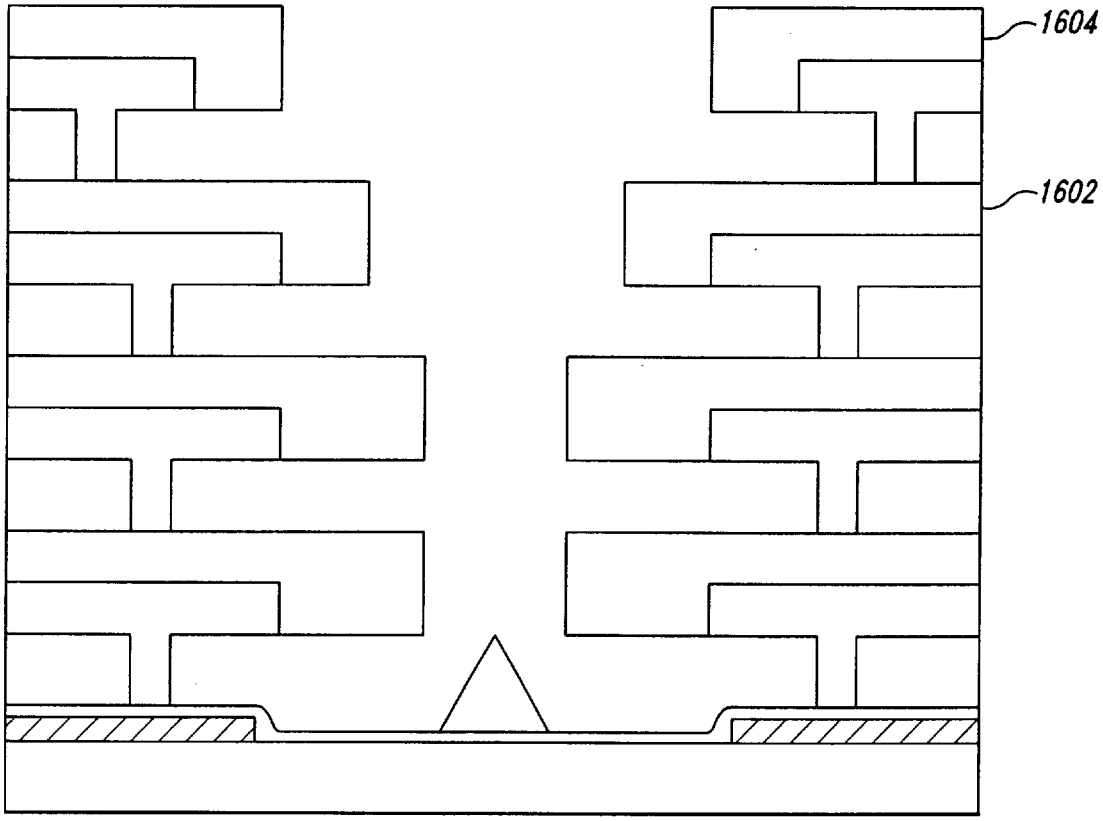
FIG. 16 shows a completed five-metal-layer field emission device produced by the above-described procedures.

Additional dielectric and metallic layers can be added by repeating the $SiO_2$, $Si_3N_4$, and metallic layer deposition and etching steps outlined above, following completion of the three-metal-layer device illustrated in FIG. 14B. FIG. 15 illustrates application of a next $SiO_2$ layer above the third metallic layer via TEOS deposition. Note that TEOS deposition fills the aperture etched into the third metal layer 1502 and results in $SiO_2$ deposition along the edges 1504 of the aperture etched into the second metal layer as well as on the surface of the field emitter tip 1506. Additional $Si_3N_4$ metallic, and $SiO_2$ layers can be added by the steps outlined above to produce a four-metal-layer field emission device or a five-metal-layer field emission device. FIG. 16 shows a completed five-metal-layer field emission device produced by the above-described procedures. Note that the $SiO_2$ deposits within the apertures and on the field emitter tip shown in FIG. 15 are removed during a final BOE wet etch. The five-metal-layer field emission device, the top two metal layers 1602–1604 may be used as orthogonal beam directing elements to steer the electron beam emitted by the field emitter tip to different positions on the target cathode (118 in FIG. 1). The fourth and fifth metal layers may be patterned with orthogonally arranged slots for electron deflection in two axes.

Figure 17:
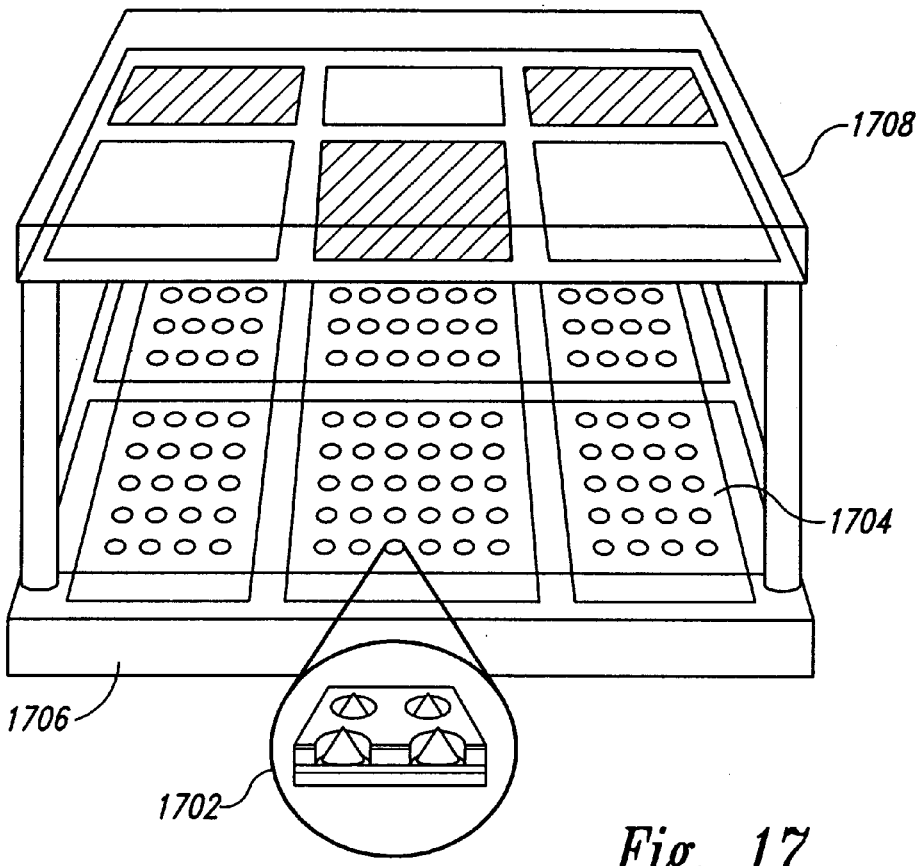
FIG. 17 illustrates a computer display device based on field emitter tip arrays.

Silicon-based field emitter tips can be micro-manufactured by microchip fabrication techniques as regular arrays, or grids, of field emitter tips. Uses for arrays of field emitter tips include computer display devices. FIG. 17 illustrates a computer display device based on field emitter tip arrays. Arrays of silicon-based field emitter tips 1702 are embedded into emitters 1704 arrayed on the surface of a cathode base plate 1706 and are controlled, by selective application of voltage, to emit electrons which are accelerated towards a face plate anode 1708 coated with chemical phosphors. When the emitted electrons impact onto the phosphor, light is produced. In such applications, the individual silicon-based field emitter tips have tip radii on the order of hundreds of Angstroms and emit currents of approximately 10 nanoamperes per tip under applied electrical field strengths of around 50 Volts.

Figure 18:
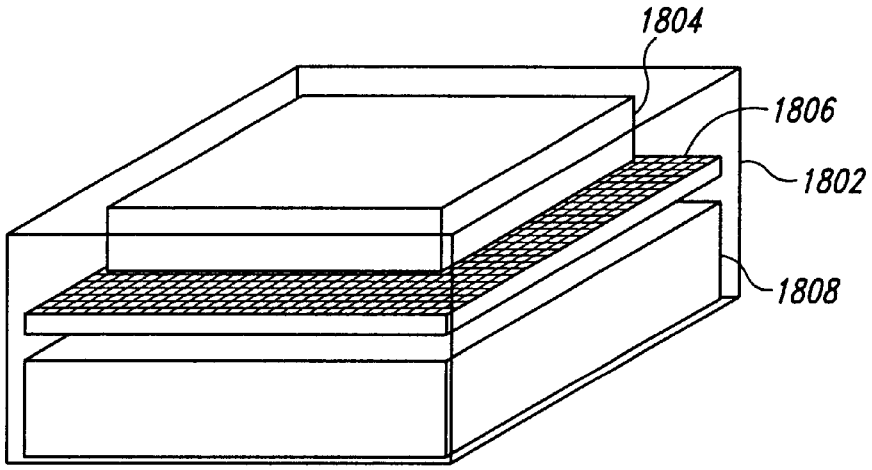
FIG. 18 illustrates an ultra-high density electromechanical memory based on a phase-change storage medium.

Silicon-based field emitter tips are also employed in various types of ultra-high density electronic data storage devices. FIG. 18 illustrates an ultra-high density electromechanical memory based on a phase-change storage medium. The ultra-high density electromechanical memory comprises an air-tight enclosure 1802 in which a silicon-based field emitter tip array 1804 is mounted, with the field emitter tips vertically oriented in FIG. 18, perpendicular to lower surface (obscured in FIG. 18) of the silicon-based field emitter tip array 1804. A phase-change storage medium 1806 is positioned below the field emitter tip array, movably mounted to a micromover 1808 which is electronically controlled by externally generated signals to precisely position the phase-change storage medium 1806 with respect to the field emitter tip array 1804. Small, regularly spaced regions of the surface of the phase-change storage medium 1806 represent binary bits of memory, with each of two different solid states, or phases, of the phase-change storage medium 1806 representing each of two different binary values. A relatively intense electron beam emitted from a field emitter tip can be used to briefly heat the area of the surface of the phase-change storage medium 1806 corresponding to a bit to melt the phase-change storage medium underlying the surface. The melted phase-change storage medium may be allowed to cool relatively slowly, by relatively gradually decreasing the intensity of the electron beam to form a crystalline phase, or may be quickly cooled, quenching the melted phase-change storage medium to produce an amorphous phase. The phase of a region of the surface of the phase-change storage medium can be electronically sensed by directing a relatively low intensity electron beam from the field emitter tip onto the region and measuring secondary electron emission or electron backscattering from the region, the degree of secondary electron emission or electron backscattering dependent on the phase of the phase-change storage medium within the region. A partial vacuum is maintained within the airtight enclosure 1802 so that gas molecules do not interfere with emitted electron beams.

Although the present invention has been described in terms of a particular embodiment, it is not intended that the invention be limited to this embodiment. Modifications within the spirit of the invention will be apparent to those skilled in the art. For example, as discussed above, Spindt-tip field emission devices can be produced with varying shapes, sizes, and geometries depending on the photolithography pattern masks employed in the various steps outlined above, ion-beam fluxes, and chemical solution and plasma compositions to which the various metallic, and dielectric layers are exposed during fabrication of a field emission device, as well as the times of exposure. A variety of different techniques can be employed for the anisotropic and isotropic etching steps as well as for layer deposition. A Spindt-tip field emitter device having arbitrary numbers of metallic layers interleaved with dielectric mono or bilayers can be produced by straightforward extensions of the above-described steps.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purpose of illustration and description. They are not intended to be exhaustive or to limit the invention to the precise forms disclosed. Obviously many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents:

What is claimed is:

1. An enhanced electron field emission Spindt tip structure, comprising:

a substrate;

a metal interconnect above the substrate to which a metal field emitter Spindt tip is affixed; and successive dielectric and metal layers, each of said dielectric layers comprising a first dielectric sublayer and a second dielectric top layer, each dielectric layer having a dielectric aperture with a first horizontal dimension, the dielectric aperture having second-dielectric vertical walls and a second-dielectric collar, each of said metal layers having a metal aperture with a second horizontal dimension smaller than the first horizontal dimension, the metal-layers thicker near the apertures and thinner where the metal-layers overlie the second dielectric top layers, the dielectric apertures and metal apertures are coaxial with the metal field emitter Spindt tip.

2. The enhanced electron field emission Spindt tip structure of claim 1 further including a resistive heating layer between the substrate and the field emitter tip so that the metal field emitter tip is heated when current is passed through the resistive heating layer.

3. The enhanced electron field emission Spindt tip structure of claim 1 including two of said successive dielectric and metal layers, the first metal layer serving as an electron extraction anode and the second metal layer serving as a focusing lens cathode.

4. The enhanced electron field emission Spindt tip structure of claim 1 including three of said successive dielectric and metal layers, the two metal layers serving as an electron extraction anode and a focusing lens cathode, respectively, and the third metal layer serving to directionally control electrons emitted from the metal field emission tip.

5. The enhanced electron field emission Spindt tip structure of claim 1 including four of said successive dielectric and metal layers, the first two metal layers serving as an electron extraction anode and a focusing lens cathode, respectively, and the second two metal layers serving to directionally control electrons emitted from the metal field emission tip.

6. The enhanced electron field emission Spindt tip structure of claim 1 wherein the first dielectric is $SiO_2$ and the second dielectric is $Si_3N_4$.

7. An ultra-high density memory device employing an electron source comprising:

a substrate;

metal interconnects above the substrate to which metal field emitter tips are affixed; and successive dielectric and metal layers, each dielectric layer comprising a first dielectric sublayer and a second dielectric top layer, each of said dielectric layers having a dielectric aperture with a first horizontal dimension and having second-dielectric vertical walls and a second-dielectric collar, each of said metal layers having a metal aperture, each of said metal apertures having a second horizontal dimension smaller than the first horizontal dimension, the metal-layers thicker near the apertures and thinner where the metal-layers overlie the second dielectric top layers, the dielectric apertures and metal apertures forming cylindrical wells coaxial with the metal field emitter tips.

8. A field emission display device employing an electron source comprising:

a substrate;

metal interconnects above the substrate to which metal field emitter tips are affixed; and successive dielectric and metal layers, each of said dielectric layers comprising a first dielectric sublayer and a second dielectric top layer, each of said dielectric layers having a dielectric aperture with a first horizontal dimension and having second-dielectric vertical walls and a second-dielectric collar, each of said metal layers having a metal aperture, each of said metal apertures having a second horizontal dimension smaller than the first horizontal dimension, the metal-layers thicker near the apertures and thinner where the metal-layers overlie the second dielectric top layers, the dielectric apertures and metal apertures forming cylindrical wells coaxial with the metal field emitter tips.

9. An electron field emission Spindt tip structure heated by electrical resistance, the electron field emission Spindt tip comprising:

a substrate;

a metal interconnect deposited above the substrate, with an interconnect gap;

a thin-film resistive heating layer deposited over the substrate within the interconnect gap and over the interconnect; and a field emitter Spindt tip fabricated on the surface of the thin-film resistive heating layer within the interconnect gap that is heated by application of an electric current to the thin-film resistive heating layer;

wherein the thin-film resistive heating layer is adapted to allow removal of contaminants adsorbed to the field emitter Spindt tip.

10. The electron field emission Spindt tip structure of claim 9, wherein the thin-film resistive heating layer is further adapted to allow for heating to high temperatures to allow for sharpening the field emitter Spindt tip.

11. The electron field emission Spindt tip structure of claim 10, further comprising:

diagnostic logic for detecting deterioration of electron current densities from the field emitter Spindt tip and applying current to the thin-film resistive heating layer to either:

1) remove contaminants from, or 2) sharpen the field emitter Spindt tip.

12. The electron field emission Spindt tip structure of claim 9, further comprising:

a dual dielectric bilayer disposed on the substrate having a cylindrical well with the field emitter Spindt tip substantially centrally positioned within.

13. The electron field emission Spindt tip structure of claim 12 wherein the dual dielectric bilayer includes means for preventing build-up of electrostatic charge during operation of the field emitter Spindt tip.

* * * * *